US005353608A

United States Patent [19]

Berkowitz

[11] Patent Number: 5,353,608

[45] Date of Patent: Oct. 11, 1994

[54] MULTI-USE JEWELRY PIECE

[75] Inventor: Jeffrey Berkowitz, Brooklyn, N.Y.

[73] Assignee: Dufonte Industries, Ltd, Wacchai, Hong Kong

[21] Appl. No.: 2,267

[22] Filed: Jan. 8, 1993

[51] Int. Cl.[5] ..... A44C 13/00

[52] U.S. Cl. ..... 63/1.1; 63/15; 63/31

[58] Field of Search ..... 63/15, 15.1, 15.2, 15.3, 63/15.4, 28, 29.2, 31, 1.1, 3, 12

[56] References Cited

U.S. PATENT DOCUMENTS

| | | | |
|---|---|---|---|
| 211,558 | 1/1879 | Edwards | 63/15 |
| 252,998 | 1/1882 | Brunswick | 63/15 |
| 774,700 | 11/1904 | Schmidt . | |
| 1,099,733 | 6/1914 | Beetar . | |
| 2,048,878 | 7/1936 | Moldenhaver | 63/15 |
| 2,177,314 | 10/1939 | VonDachenhausen . | |
| 2,585,185 | 2/1952 | Stern | 63/15 |
| 3,263,444 | 8/1966 | Di Croce | 63/29.2 |
| 4,080,803 | 3/1978 | Suzuki . | |
| 4,165,621 | 8/1979 | Gould | 63/15 |
| 4,726,200 | 2/1988 | Carter . | |
| 4,733,544 | 3/1988 | Londaro | 63/15 |
| 4,841,746 | 6/1989 | Chen . | |
| 4,932,396 | 6/1990 | Garris | 63/15 |

FOREIGN PATENT DOCUMENTS

| | | | |
|---|---|---|---|
| 547066 | 2/1922 | France | 63/12 |
| 896557 | 7/1943 | France | 63/15.1 |
| 1537955 | 8/1968 | France | 63/29.2 |
| 2291716 | 6/1976 | France | 63/15 |

*Primary Examiner*—Flemming Saether
*Attorney, Agent, or Firm*—Darby & Darby

[57] ABSTRACT

A multi-use jewelry device having a setting member for holding first and second display objects, such as gems or stones, in opposite facing directions. A pair of hoops are pivotally connected to said setting member and by rotating the hoops in opposite directions above and below the setting member, the hoops when lying adjacent one another form a body mounting members, such as a ring or bracelet with one of the display objects being displayed. The hoops also can have an ear fastening device so that an earring is provided when selectively displays one or the other of the objects when the device is fastened to the ear or they can have a member for accepting a chain so that the device can serve as a pendant. The hoops are held together by a magnet arrangement a the bottom of the hoops from the setting.

10 Claims, 3 Drawing Sheets

MULTI-USE JEWELRY PIECE

BACKGROUND OF THE INVENTION

In various types of jewelry articles, it is sometimes desirable that the article have a plurality of uses or be capable of being configured in different ways for a different display of jewelry.

For example, in U.S. Pat. No. 4,841,746 to Chen a ring is displayed having a axle about which various ringlets pivot. Each ringlet carries a different stone. In U.S. Pat. No. 4,726,200 to Carter, a combined ring-pendant is disclosed in which a setting holder is rotated between a ring position and a pendant position. Further, in U.S. Pat. No. 4,080,803 to Suzaki, there is a central ring having a stone at the top thereof. Secondary rings can be snapped on each or both sides of the central ring, each of the secondary rings also carrying a stone to form a complete and different stone setting.

OBJECT OF THE INVENTION

It is an object of the present invention to provide a multi-use jewelry piece using only one setting and which is capable of selectively displaying one of two stones or gems held thereon.

Another object is to provide a jewelry piece which is capable of selectively displaying one of two stones when used as a ring, bracelet, pendant, earring or stick-pin.

An additional object is to provide a multi-use piece of jewelry having a single setting which carries two different stones with a pair of hoops which are a pivotal around the setting above and below it and in opposite directions so that one of the two stones carried by the setting is selectively displayed when the item is worn by a user.

Another object is to provide a jewelry piece which is capable of selectively displaying one of two stones when used as a ring, bracelet, pendant, earring or stick-pin by providing a single setting which carries two different stones with a pair of hoops which are a pivotal around the setting above and below it and in opposite directions so that one of the two stones carried by the setting is selectively displayed when the item is worn by a user.

BRIEF DESCRIPTION OF THE DRAWINGS

Other objects and advantages of the present invention will become more apparent upon reference to the following specification and annexed drawing in which.

DETAILED DESCRIPTION OF THE INVENTION

Figure 1:
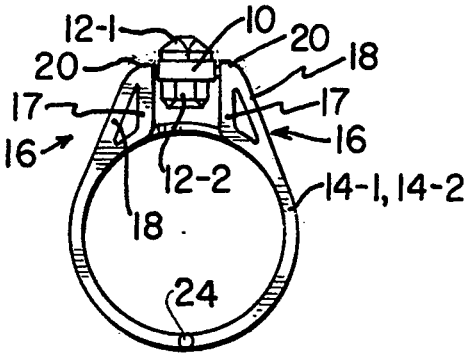
FIG. 1 is a side view of the jewelry piece.

Referring to the drawings and particularly to FIGS. 1–3, the jewelry piece according to the invention has a central setting 10 which can be, for example, a wire hoop or solid member of desired shape and size. The various parts of the jewelry piece can be of any precious, semi-precious or non-precious materials, e.g., gold, silver, various alloys, etc. The type of material used for the setting and other parts of the jewelry piece are not critical to the invention.

Figure 2A:
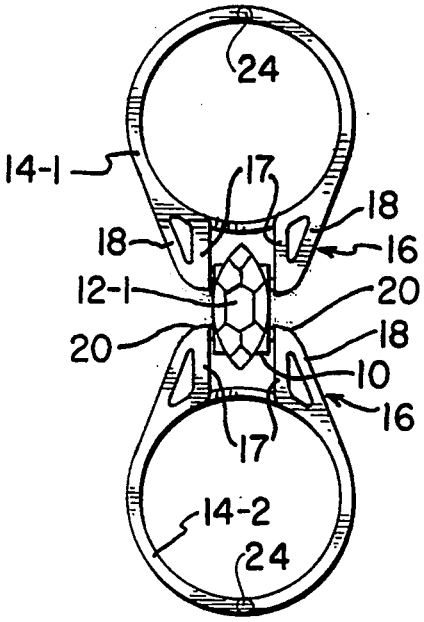
FIGS. 2A and 2B are views with the hoops spread apart showing each of the two different stones.
Figure 2B:
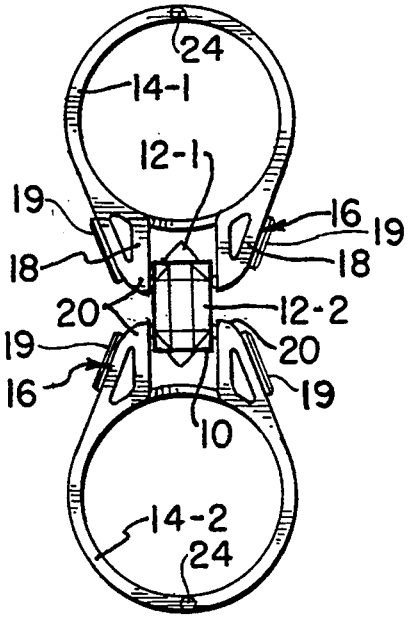

Mounted within the setting 10 is a dual display item formed by two parts 12-1 and 12-2, here illustratively gems or diamonds. The display parts 12-1, 12-2 can be fused or joined together by any suitable arrangement, e.g., an adhesive. Alternatively, they can be held together within the setting 10 by making the central hoop portion 10 thereof wide enough. The type, size and shape of the display item 12 used also is not critical to the invention. As seen in FIGS. 1, 2A and 2B, the part 12-1 is a gemstone of elliptical shape wherein part 12-2 is one of square shape. The setting 10 is modified to accommodate the size and shape of the display items 12.

The piece includes a pair of hoops 14-1 and 14-2 of similar construction. Each hoop 14 has a pair of truss members (FIG. 2A) 16 at the top thereof which are formed by straight pieces 17 and an angled piece 18. Each of the members 17, 18 forming each of the trusses 16 is suitably affixed to the hoop 14, for example, by soldering. Illustratively shown in FIG. 2B, each of the trusses can have a baguette 19 mounted to it to cover the truss and to further enhance the beauty of the jewelry piece.

The end, or peak, 20 of each truss, where members 17, 18 are joined together, is pivotally connected to the central setting 10 of the ring (see FIG. 3). That is, each of the peaks 20 of each of the trusses 16 is attached to the central setting support 10 so that it can be pivoted thereto. This can be accomplished, for example, by making a wire loop at the end 20 of each truss which pivots on an axle which is fastened to the outside of the central member 10 or directly pivotally connected by a hinge arrangement to the central member. Alternatively, the central setting member 10 can be provided with a curved eye projection, there being a total of four such projections, to which a peak 20 of a truss provided with a closed hook can be attached and can pivot around it.

Figure 3A:
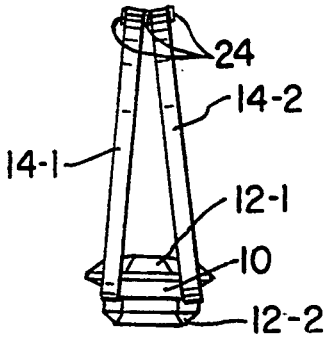
FIGS. 3A–3I show a series of views in which the hoops are moved from one extreme position displaying one stone to another extreme position displaying the other stone.
Figure 3B:
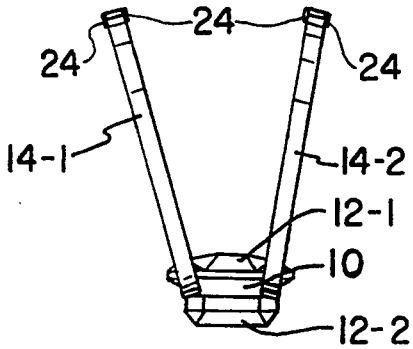
Figure 3C:
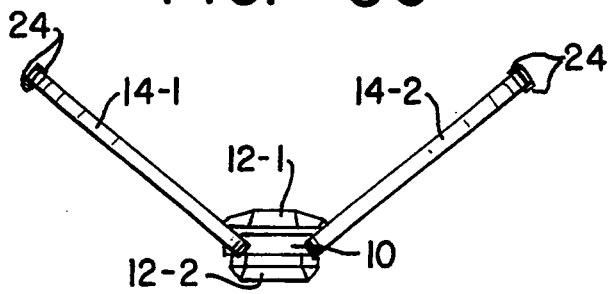
Figure 3D:
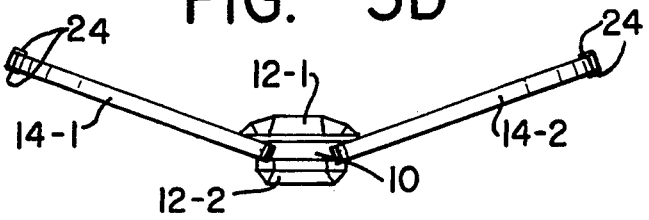
Figure 3E:
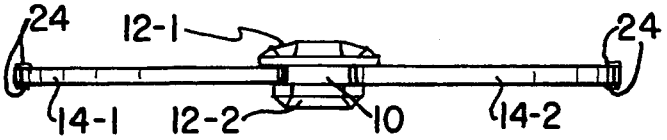
Figure 3F:
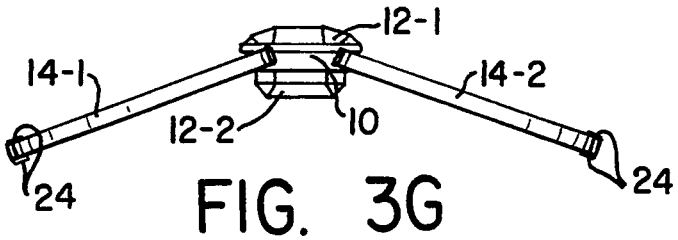
Figure 3G:
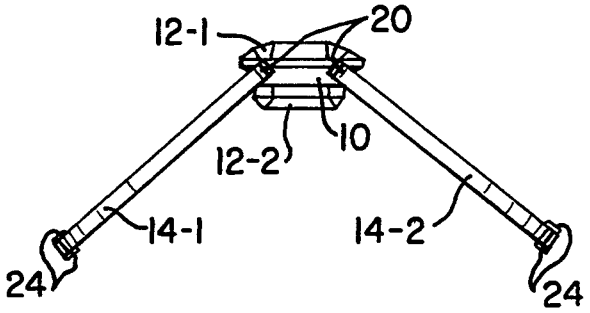
Figure 3H:
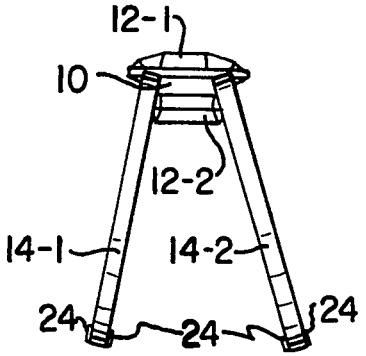
Figure 3I:
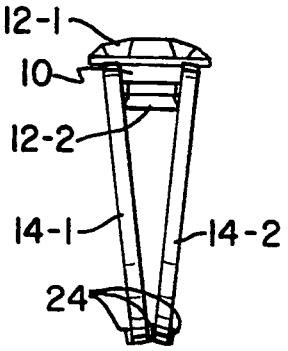

At the bottom on the opposite vertical faces of each hoop 14 a small magnet piece is mounted. That is, there are four magnet pieces, which can be small dot type magnets. When two opposing magnets of the different hoops come close to each other, they provide a force to hold the hoops together, as shown in FIGS. 3A and 3I. Since the magnets are on the vertical faces of the hoops, they do not extend above or below the internal or external hoop surfaces. If the hoops 14 are of a material which is magnetically attractive, then only one hoop need be provided with the magnet pieces 24 on its opposite vertical faces.

FIG. 3 shows the operative features of the invention. In FIG. 3, the two hoops 14-1 and 14-2 are placed adjacent to each other. If the hoops comprise rings, then the jewelry piece can be placed over one of the fingers of a user and the jewelry item 12-2 would be displayed. If the user wishes to display item 12-1, he or she removes the ring from the finger and pivots the two hoops 14-1 and 14-2 in opposite directions from one side of the jewelry display item 12 to the other. As seen in referring to FIGS. 3B–3I, the two hoops 14-1 and 14-2 are rotated so that to the position shown in FIG. 3I. Here, as can be seen, with the hoops 14-1 and 14-2 being adjacent one another and forming a ring, that the jewelry item 12-1 is now being displayed if the ring is inserted over the finger of the user.

The jewelry piece shown in FIGS. 1–3 as a ring can be adopted to serve other functions. For example, the hoops 14-1, 14-2 can be made larger to serve as a bracelet.

Figure 4:
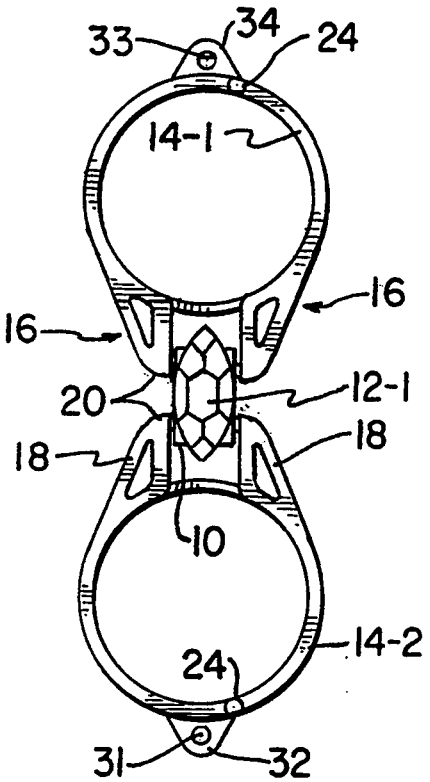
FIG. 4 is a view similar to FIG. 2 showing the piece with fastening means for an earring.

Also, as shown in FIG. 4, there are on each of the hoops 14-1 and 14-2 at about a point diametrically opposite the jewelry items 12-1 and 12-2 parts 30–32 for serving as an earring holder. These can be, for example, the usual earring pins which pierce through the ear of the wearer or else a screw-type arrangement. The latter is shown in FIG. 4 as a screw 31 mounted on hoop extension 32 there being a thread receiving member 33 on the extension 34 on the other hoop. The choice of display of items 12-1 or 12-2 is accomplished in the same manner as shown with respect to FIGS. 1–2.

Figure 5:
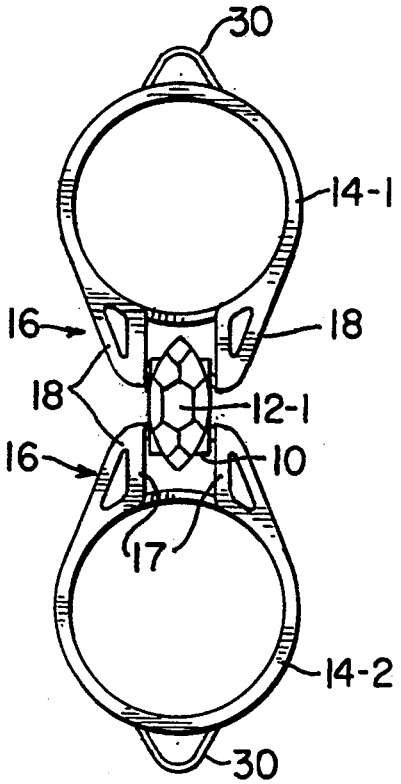
FIG. 5 is a view similar to FIG. 2 showing the piece as used for a pendant.

FIG. 5 shows a further embodiment of the invention wherein the item is used as a pendant. Here, at the part of each of the hoops remote from the jewelry items 12-1 and 12-2 there is a curved portion 30 to accommodate a chain which the user wears around his or her neck. If desired, an arrangement can also be provided for snapping the two hoops together at the points where the projections are present.

Figure 6:
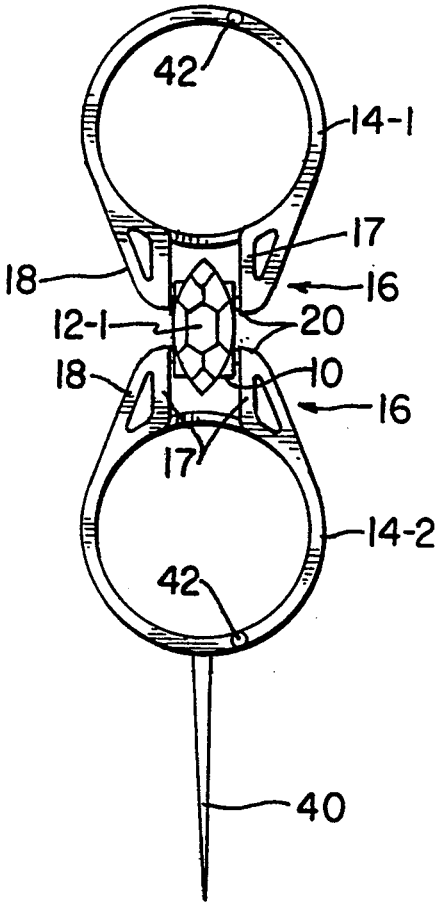
FIG. 6 is a view similar to FIG. 2 showing an arrangement for using the piece as a stick pin.

FIG. 6 shows a further embodiment of the invention which is modified as a stick pin. Here, the pin 40 is attached to the part of one of the hoops 14 which is remote from the setting 10 and there is a suitable fastening arrangement such as a snap fit 42, to snap the two together. The magnets 24 of FIGS. 1–3 also can be used.

In any of the embodiments shown in the various figures of the drawings, it should be clear that either one of the jewelry pieces 12-1 and 12-2 can be selectively displayed merely by rotating the two hoops 14 from a position from one side of the setting 10 to a position on the other side of the setting.

It should be understood that any suitable type, size and shape of jewelry piece 12 can be used. This can be, for example, rare or precious stones, synthetic stones, pictures, etc.

What is claimed:

1. A multi-use jewelry device comprising:

setting means for holding first and second separate and different display objects opposite each other and each with a portion thereof extending outwardly of said setting means, and first and second continuous hoops each with a truss extending radially outwardly therefrom, said trusses being connected to said setting means between the two display objects, each of said hoops is pivotable by substantially 180° in opposite directions above and below said setting means to be adjacent to each other for selectively orienting said first and second display objects for selective display of the extending portion thereof.

2. A device as in claim 1, wherein the size of said hoops when adjacent one another permits a part of the body to be inserted through said hoops.

3. A device as in claim 2 wherein said hoops are in the shape of rings for a finger to fit therein.

4. A device as in claim 2 wherein said hoops are in the shape of a bracelet.

5. A device as in claim 1 further comprising means on at least one of said hoops for holding said hoops together when they are adjacent each other.

6. A device as in claim 5 wherein said holding means comprises at least one magnet on one of said hoops.

7. A device as in claim 6 wherein there is a magnet on each hoop which coact to hold the hoops together.

8. A device as in claim 1 further comprising cooperating means on said hoops remote from said setting means to fasten said device to an ear as an earring.

9. A device as in claim 1 further comprising stick pin means on at least one of said hoops remote from said setting means and means for holding said hoops together.

10. A device as in claim 1 wherein said setting means comprises at least one wire hoop.

* * * * *

UNITED STATES PATENT AND TRADEMARK OFFICE

CERTIFICATE OF CORRECTION

PATENT NO. : 5,353,608
APPLICATION NO. : 08/002267
DATED : October 11, 1994
INVENTOR(S) : Jeffrey Berkowitz It is certified that error appears in the above-identified patent and that said Letters Patent is hereby corrected as shown below:

On Title page Item 75
Add inventor: Joe Richard Tanory, Jr.

Signed and Sealed this

Eleventh Day of July, 2006

JON W. DUDAS
*Director of the United States Patent and Trademark Office*